US007174947B2

(12) United States Patent
Olmsted

(10) Patent No.: US 7,174,947 B2
(45) Date of Patent: Feb. 13, 2007

(54) METHOD OF SIZING OVERFLOW CHAMBERS

(75) Inventor: Peter Olmsted, Ann Arbor, MI (US)

(73) Assignee: Peter B. Olmsted Trust, Ann Arbor, MI (US)

( * ) Notice: Subject to any disclaimer, the term of this patent is extended or adjusted under 35 U.S.C. 154(b) by 0 days.

(21) Appl. No.: 10/485,719

(22) PCT Filed: Jul. 26, 2002

(86) PCT No.: PCT/US02/23733

§ 371 (c)(1),
(2), (4) Date: Aug. 3, 2004

(87) PCT Pub. No.: WO03/011499

PCT Pub. Date: Feb. 13, 2003

(65) Prior Publication Data

US 2004/0261972 A1 Dec. 30, 2004

Related U.S. Application Data

(60) Provisional application No. 60/308,769, filed on Jul. 31, 2001.

(51) Int. Cl.
*B22D 17/10* (2006.01)

(52) U.S. Cl. ..... 164/312; 164/113; 164/457

(58) Field of Classification Search ..... 164/113, 164/312–318, 4.1, 457
See application file for complete search history.

(56) References Cited

U.S. PATENT DOCUMENTS 6,113,828 A * 9/2000 Feick ..... 264/161

* cited by examiner

*Primary Examiner*—Kuang Y. Lin
(74) *Attorney, Agent, or Firm*—Fay, Sharpe, Fagan, Minnich & McKee, LLP

(57) ABSTRACT

A method for sizing an overflow chamber (46) in a mold (32) for the die casting of metals is disclosed. The method includes the steps of simulating a pressure of molten metal (30) in a main cavity (42) of the mold (32) and calculating the volume of the overflow chamber (46) from parameters yielded by the pressure simulation. A mold (32) defining overflow chambers (46) is also disclosed.

2 Claims, 7 Drawing Sheets

METHOD OF SIZING OVERFLOW CHAMBERS

CROSS REFERENCE TO RELATED APPLICATION

This application claims the benefit of U.S. provisional application Ser. No. 60/308,769, filed Jul. 31, 2001.

BACKGROUND OF THE INVENTION

1. Field of the Invention

The present invention relates to the art of die casting of metals. More particularly, the present invention relates to the design of molds for the die casting of metals. Still more particularly, the present invention relates to the design of overflow gates and overflow chambers in molds for the die casting of metals.

2. Description of Related Art

In the die casting of metals, metal that has been heated to become molten is forced into at least one cavity in a die or mold under pressure. The die typically includes at least two mating parts that can be separated to facilitate removal of the cast part when it has cooled sufficiently. For the purpose of simplicity, the die or mold will be described herein with reference to two mating parts or halves. Until the metal is cool enough to be removed, the die halves must be held together under pressure by a clamping force. The clamping force is often extremely high in order to overcome the force exerted by the molten metal as it is driven into the cavity and thereby keep the die halves effectively sealed.

It is known that the quality of the casting improves with more rapid flow of the molten metal into the die cavity. With conventional control systems, however, as the velocity of the flow of the molten metal into the cavity increases, the pressure that the metal exerts on the die increases. At some point, that pressure might be sufficiently high to overcome the clamping force, causing the die halves to separate and allow metal to leak from the cavity, thereby destroying the integrity of the cast part. As a result, the pressure within the die cavity must be controlled in the die casting process.

To illustrate the details surrounding the problem of pressure control in die casting, FIG. 1 shows a schematic arrangement of the major components typically associated with the die casting process. A hydraulic accumulator 10 pressurizes hydraulic fluid that is transferred through an inlet throttle valve 12 to a hydraulic cylinder 14. Adjustment of the inlet throttle valve 12 and an outlet throttle valve 16 allow the movement of an actuating piston 18 to be controlled. The actuating piston 18 is secured to an intermediate connection 20, which allows the actuating piston to drive a plunger 22.

The plunger 22 terminates with a plunger tip 24 that is sized to correspond to an inner diameter of a cold chamber 26. A pour port 28 facilitates the ladling of molten metal 30 into the cold chamber 26 when the plunger 22 is retracted. The metal 30 is forced by the plunger tip 24 into cavities formed in a mold or die 32.

At the beginning of a "shot" cycle, the actuating piston 18 and plunger 22 are fully retracted, allowing molten metal 30 to be ladled into the cold chamber 26 through the pour port 28. The piston 18 is then caused to advance slowly toward the die 32 (to the left in FIG. 1) so that the plunger tip 24 closes off the pour port 28. When the actuating piston 18 is in mid stroke, it continues to move at a relatively slow velocity to prevent waves in the metal 30 from trapping air. Once the plunger tip 24 has moved far enough in the direction of the mold 32 to substantially displace the air from the cold chamber 26, the plunger 22 is normally accelerated to a higher speed.

Control of the speed of the plunger 22 and plunger tip 24 typically is accomplished by controlling the speed of the actuating piston 18 through adjustment of the hydraulic inlet throttle valve 12 and the outlet throttle valve 16. The inlet throttle valve 12 normally is only partially open during the slow portion of the shot, but is opened wide at the transition to the high-speed portion of the shot. During the high-speed portion of the shot, the speed of the system typically is controlled with the hydraulic outlet throttle valve 16. Other sequences of valve control are practiced, but the resulting transition from low speed to high speed is similar.

The mold or die 32 shown in FIG. 1 includes a stationary half 34 and a movable half 36. The stationary mold half 34 and the movable mold half 36 are held together by a clamping mechanism (not shown) as known in the art. The molten metal 30 is forced from the cold chamber 26 through a main gate 38 and to a runner system 40 that leads to at least one main cavity 42. At least one overflow gate 44 extends from each main cavity 42 and each overflow gate 44 leads to an overflow chamber 46. Molds typically include multiple overflow chambers 46, with each chamber having a respective gate 44, to be described in greater detail below.

Prior to the time that the molten metal 30 reaches the main gate 38, the pressure in the runner system 40 is essentially zero. As soon as the metal 30 reaches the main gate 38, however, the restricted cross-sectional area of the main gate 38 and the high velocity of the plunger tip 24 combine to raise the pressure of the molten metal 30 in the runner system 40 to a value that might be as high as 1,000 pounds per square inch (psi). Meanwhile, until the main cavity 42 fills, the pressure therein remains relatively low. When the main cavity 42 fills and its pressure starts to rise as the hydraulic cylinder 14 continues to urge the plunger tip 24 forward, molten metal flows through the main cavity 42 and through the overflow gates 44 to the overflow chambers 46. As is well known in the die casting art, the flow of the molten metal 30 into the overflow chambers 46 assists in filling voids in the metal that is in the main cavity 42. The details of this flow will be described below.

Rapid flow of the molten metal 30 into the main cavity 38 leads to advantageous properties in the resulting casting. However, the velocity during the high-speed portion of the shot is limited by the ability of the clamping force to hold the stationary mold half 34 and the movable mold half 36 together due to the impact pressure that occurs when the main cavity 38 fills with fluid molten metal 30. Specifically, if the speed of the plunger 22 (and therefore the speed of the molten metal 30) is too high, the impact pressure of the molten metal 30 on the mold 32 will be too high. This will cause the mold halves 34 and 36 and the clamping mechanism to deflect, allowing the mold 32 to open slightly, which in turn allows some of the molten metal 30 to emerge from the mold 32, or at least to create flash. Flash is a thin film of metal that undesirably spreads out on the parting line of the mold halves 34 and 36 from the main cavity 38 and/or the runner system 40.

Because the impact pressure of the molten metal 30 on the mold 32 is proportional to the speed of the plunger 22, systems of the prior art have concentrated on control of the plunger 22 to decelerate it rapidly and thereby decrease the impact pressure of the metal 30 on the mold 32 just before the mold 32 fills. Typically, valves have been employed on the hydraulic cylinder 14 to release the hydraulic pressure on the actuating piston 18, thereby decreasing the speed of the plunger 22.

FIGS. 2 and 3 show a typical raw casting 48 as it appears when it is removed from the mold 32 (referring back to FIG. 1). The raw casting 48 essentially is a solid body defined by the cavities, chambers, gates, runners and other openings formed in the mold 32. The raw casting 48 is a symmetrical part, including a runner formation 50 (corresponding to the runner system 40 of the mold 32) leading to a main gate formation 52 on each half of the raw casting 48 and then to the actual cast part 53 that is formed in the main cavity 42 of the mold 32. The presence of multiple overflow metal formations 54, each connected to the actual cast part 53 by an overflow gate formation 56, illustrates the placement of the overflow chambers 46 and overflow gates 44 in the mold 32. In some applications, metal may flow through the overflow chamber 46 and into an air vent, creating a corresponding metal formation 58.

Referring now to FIGS. 1–3 in combination, it is well known to place overflow chambers 46 around the periphery of the main cavity 42 of a die cast mold 32. Overflow chambers 46 are required because the die casting process invariably causes a mixing of air in the initial molten metal 30 that flows through the main cavity 42, as the initial portion of the molten metal 30 pushes air ahead of it. The overflow chambers 46 provide a place for that aerated metal to flow, allowing the denser, non-aerated molten metal 30 to fill the main cavity 42 and produce a higher-quality part.

The overflow chambers 46 are located on the periphery of the main cavity 42, which is the area that the metal 30 reaches last. In addition, the restricting overflow gate 44 that leads to each overflow chamber 46 requires increased pressure in the main cavity 42 to cause the molten metal 30 to flow through each gate 44. These factors combine to keep the overflow chambers 46 relatively empty as the main cavity 42 fills.

Once the main cavity 42 fills significantly, the pressure exerted by the plunger 22 causes the metal 30 to pass through the overflow gates 44 and into the overflow chambers 46. The generation of the pressure that causes the metal 30 to flow into the overflow chambers 46 corresponds to the generation of the impact pressure described above that may cause the mold 32 to deflect.

The placement and total volume of the overflow chambers in the prior art typically has been determined by the past experience of the mold designer as well as by trial-and-error, with the objective of a placement and volume that allows the maximum amount of aerated molten metal to flow into the overflow chambers, ideally resulting in a minimal level of porosity in the final part. Another design consideration, the total cross-sectional area of the gates that lead to the overflow chambers, has generally been set equal to or approximately equal to the cross-sectional area of the main gate between the runner system and the main cavity. As a result, there has been no consideration in the prior art of designing the volume of the overflow chambers and the cross-sectional area of the overflow gates to relieve the impact pressure of the molten metal on the mold.

Accordingly, it is desirable to develop a method and an apparatus to allow the overflow chambers and overflow gates to be designed to reduce the impact pressure of the molten metal on the mold, thereby reducing the force required to clamp the mold halves and shut. The invention includes a process that reduces the metal pressure during the deceleration of the plunger that drives metal into the mold of a die-casting machine by sizing the overflow chambers and overflow gates in a new way.

SUMMARY OF THE INVENTION

The present invention provides a method for sizing overflow chambers for molds in the die casting of metals and overflow gates and chambers produced by the method.

In accordance with one exemplary embodiment of the present invention, a method for sizing an overflow chamber in a mold for the die casting of metals is disclosed. The method includes the steps of simulating a pressure of molten metal in a main cavity of the mold and calculating the volume of the overflow chamber from parameters yielded by the pressure simulation.

In accordance with another exemplary embodiment of the present invention, a method for sizing a gate of an overflow chamber in a mold for the die casting of metals is provided. The method includes the steps of providing a desired maximum pressure for a molten metal in a main cavity of the mold, generating a first total cross-sectional area for all overflow gates and calculating a first transition point. A second peak pressure is determined from parameters at the first transition point and the second peak pressure is compared to the desired maximum pressure. A second total cross-sectional area for all overflow gates is generated when the second peak pressure approximately equals the desired maximum pressure and the gate is sized by subtracting the second total cross-sectional area for all overflow gates from the first total cross-sectional area for all overflow gates.

In accordance with yet another exemplary embodiment of the present invention, a mold for the die casting of metals defining a plurality of overflow chambers is provided. The mold defines at least two overflow chambers and an overflow gate for each overflow chamber, wherein the cross-sectional area of each overflow gate is substantially less than the cross-sectional area of a gate of a main cavity defined by the mold.

BRIEF DESCRIPTION OF THE DRAWINGS

The invention may take form in certain components and structures, preferred embodiments of which will be illustrated in the accompanying drawings, wherein.

DETAILED DESCRIPTION OF THE PREFERRED EMBODIMENTS

The impact pressure of the molten metal on the mold may be controlled by appropriately setting the volume of the overflow chambers and the cross-sectional area of the gates of the overflow chambers. This process shall be termed "sizing." The overflow chambers and overflow gates of a mold may be sized to minimize the impact pressure on the mold, while continuing to perform their traditional function of suppressing porosity in the cast part. The method of the present invention takes into consideration the pressure in the main cavity and the changing velocity of the plunger after the main cavity fills and before the plunger comes to a stop.

Figure 1:
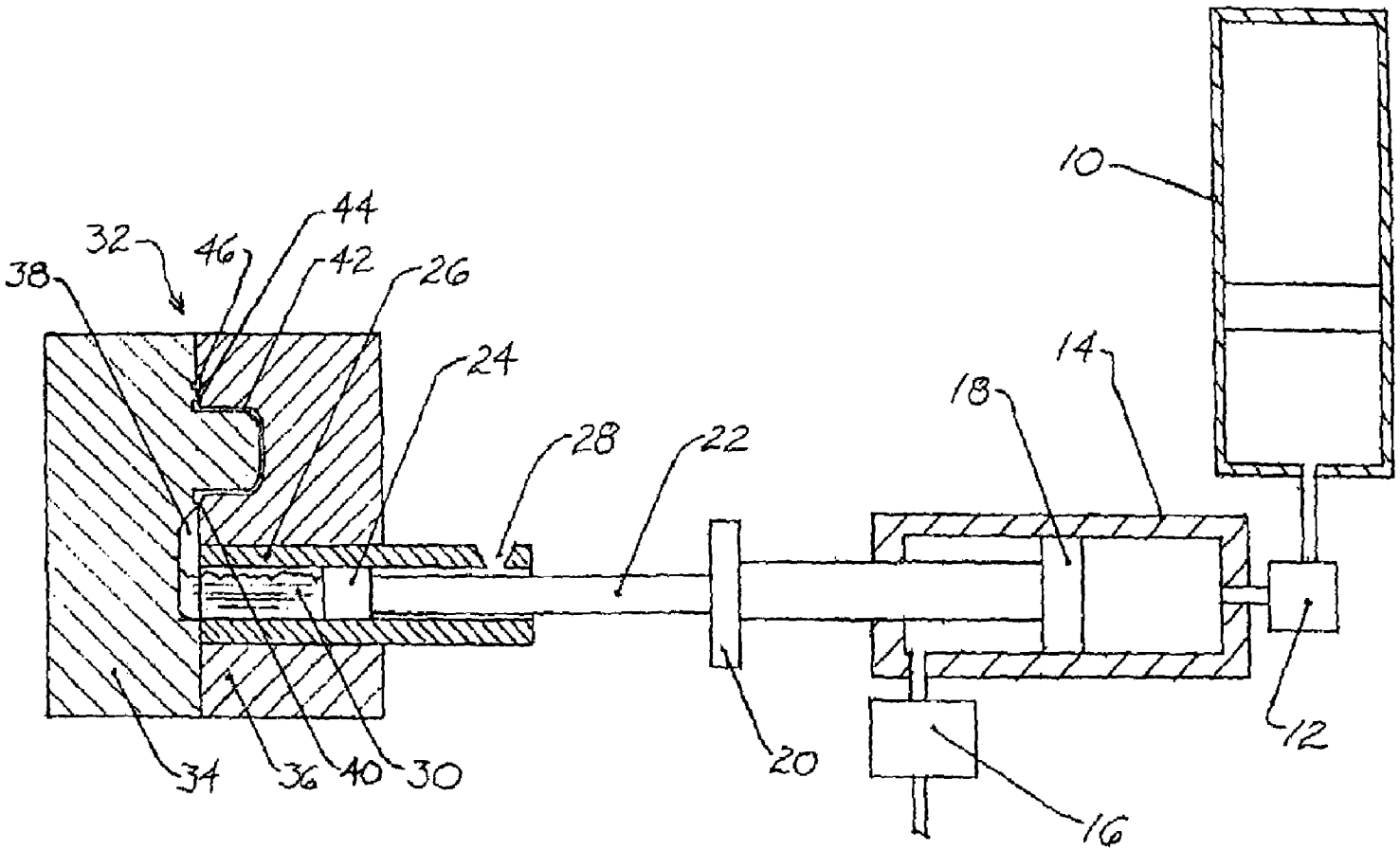
FIG. 1 is side view schematic arrangement of the major components associated with the die casting process.
Figure 2:
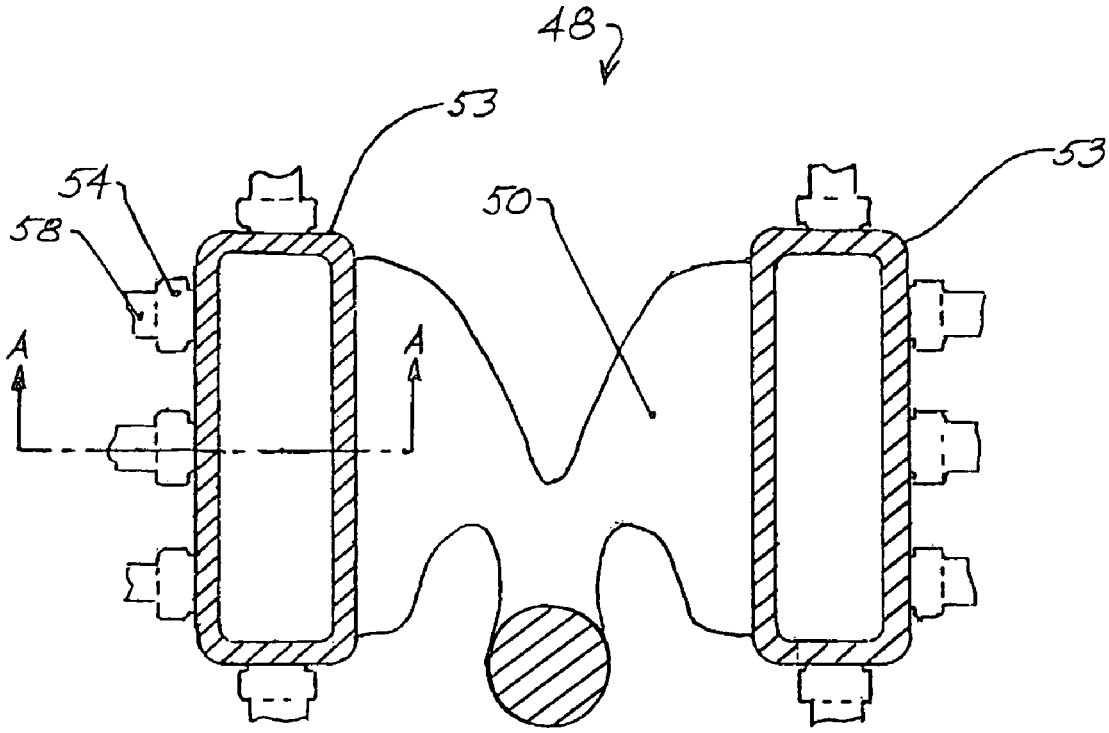
FIG. 2 is a top view, shown partially in section, of a raw casting.
Figure 3:
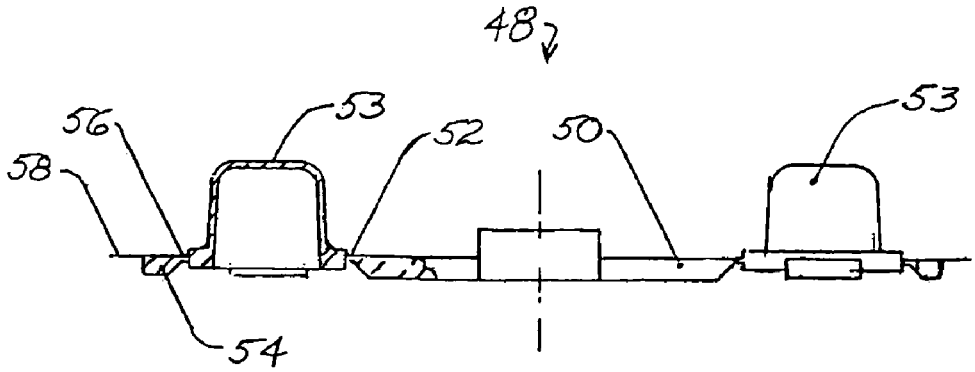
FIG. 3 is a side view of the raw casting of FIG. 2, shown partially in section along line A—A from FIG. 2.
Figure 4:
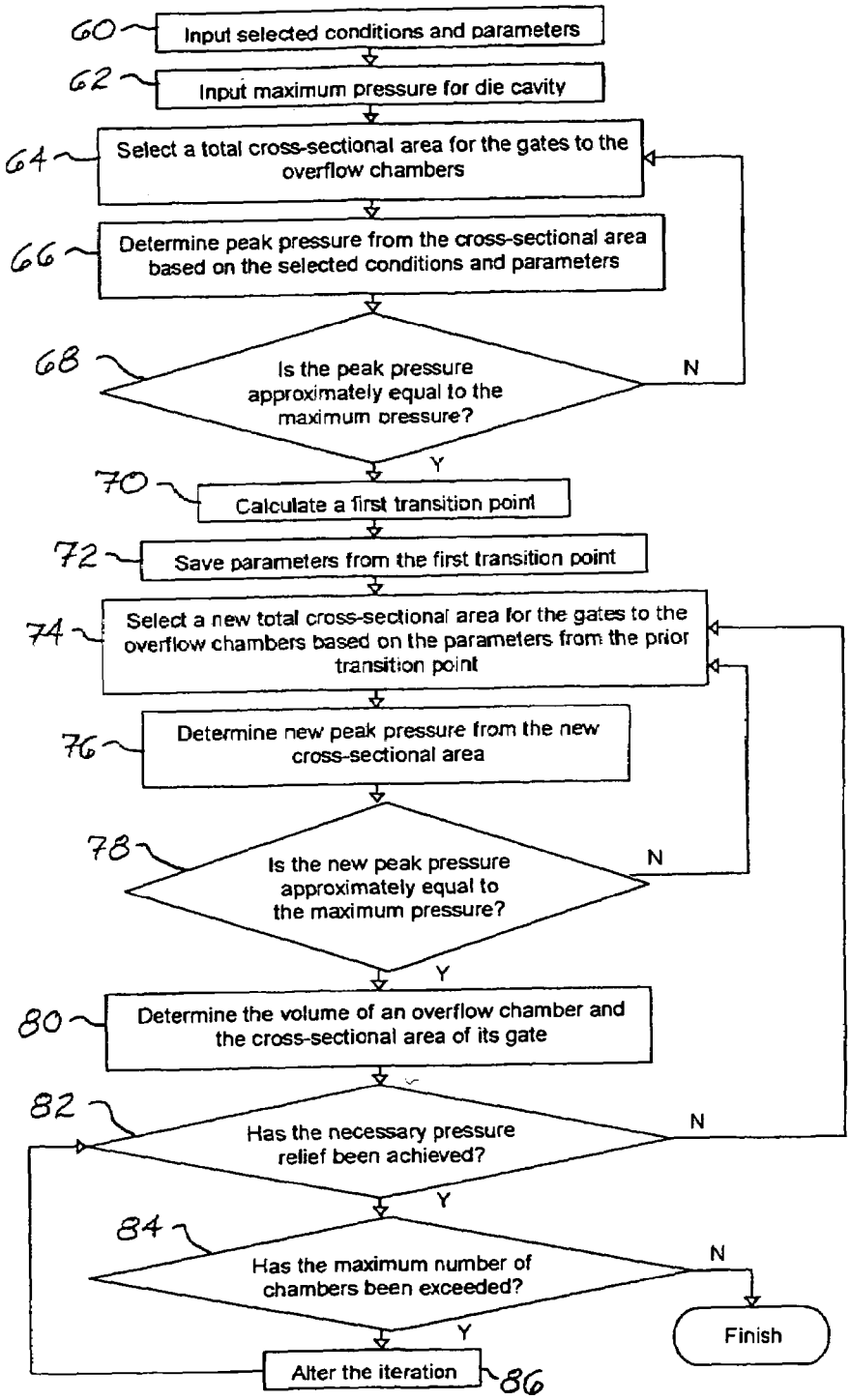
FIG. 4 is a flow chart illustrating steps of a method in accordance with an embodiment of the present invention.

Referring now to the drawings, wherein the showings are for purposes of illustrating preferred embodiments of the invention only and not for purposes of limiting the same, FIG. 4 shows the steps of the method of one embodiment of the present invention.

The method assumes that at a time designated as time zero, the plunger is traveling at a speed that is equal to the maximum speed of the plunger attained during the high-speed phase of the shot cycle. The method also assumes that, prior to time zero, there is a specified pressure in the runner system and there is zero pressure in the mold cavity. Moreover, it is assumed that the overflow chambers are empty at time zero. The actual conditions of the system may differ somewhat from these assumptions, but the assumptions allow a valid analysis to take place and result in a mold having overflow chambers and overflow gates sized to reduce the clamping force required by conventional mold design methods.

The initial conditions and pertinent parameters of the specific die cast process to be analyzed are taken into consideration, step 60. These conditions and parameters may include:

- Weight of the piston, plunger, and tip, in pounds (lbs)
- Plunger velocity at impact, in inches per second (in/sec)
- Diameter of the piston, in inches (in)
- Diameter of the piston rod (in)
- Diameter of the plunger tip (in)
- Pressure of the accumulator, in pounds per square inch (psi)
- Pressure of the cold chamber at impact (psi)
- Weight of the trimmed casting (lbs)
- Number of cavities in the mold
- Weight of the runner system (lbs)
- Ratio of mold expansion to molten metal compression
- Identification of the casting metal (aluminum, magnesium, etc).

Another parameter that may be considered is an estimate of the percentage of cold chamber air that is engulfed in the metal. The above data may be input into a data table for use on a recurring basis. From this data, other parameters may be calculated, such as the equivalent flow area of the main gate and the restrictive effect of the hydraulic system.

The major forces acting on the piston and the resulting metal pressures are due to restrictions at the main gate and the overflow gates. As stated above, it is assumed there is zero pressure along the front of metal as it approaches the overflow gates to simplify the analysis. The data above is used in the following equations to determine other parameters in the system. For example:

$$dV=g*(Fpist-Prun*Atip)*dT/W \text{ (in/sec)}.$$

The value dV is the increase in piston velocity in time dT, where dT is the time step in seconds (assumed to be 0.0005 milliseconds), g is the acceleration due to gravity (386 inches per second per second), Prun is the pressure in the runner system at time T, Atip is the area of the plunger tip or the cross-sectional area of the cold chamber, and W is the weight of the piston, plunger, and tip. Fpist is the net force applied by the driving piston at time T and is determined by the equation:

$$Fpist=(Apist*Pacc)*(1-(V/Vo)**2)+PMo*Atip*(V/Vo)**2.$$

Pacc is the accumulator pressure in psi (assumed be constant during the run), Apist is the cross-sectional area of the actuating piston, in square inches (sq.in.), Pmo is the pressure in the runner system at T=0, V is the plunger velocity at time T, and Vo is the plunger velocity at T=0.

The flow (in cubic inches per second, cu.in./sec.) through the main gate between the runner region and the cavities at time zero is Qo, where Qo=Atip*Vo. During a run the flow through the main gate is Q, where $Q=Qo*\sqrt{((Prun-Pcav)/PMo)}$ when (Prun−Pcav) is positive and $Q=-Qo*\sqrt{((Pcav-Prun)/PMo)}$ when (Prun−Pcav) is negative. Pcav is the pressure in the main cavity at time T.

The flow through the overflow gate "i" is QOV(i) cu.in./sec. Before overflow "i" fills:

$$QOV(i)=Fcoef*Orf(i)*\sqrt{(2*g*Pcav/Denc)}.$$

Orf(i) is the cross-sectional area of the gate of overflow chamber "i", Denc is the density of the molten metal (psi), and Fcoef is the flow coefficient. As is known in the art, a perfectly rounded nozzle has a flow coefficient approaching 1.00, while a sharp-edged circular orifice has a flow coefficient of around 0.63. It is estimated in the present invention that a long narrow slot, like a typical gate, should have a flow coefficient of about 0.78, which is the value used herein. QOV(i)=0 when Vol(i)−Fill(i) becomes less than or equal to zero. Fill(i) is the amount of metal that has flowed into overflow chamber "i" at time T, and Vol(i) is the volume of overflow chamber "i" as specified by the data or calculated.

The change in Fill(i) at each time step is QOV(i)*dT, and the change in Prun at each time step is dPrun:

$$dPrun=(V*Atip-Ncav*Q)*RunRate*dT.$$

Ncav is the number of cavities as supplied by the data, and RunRate is the spring rate of the runner system. If the mold were infinitely stiff, RunRate would be equal to E*Denc/Wrun, where E is the modulus of elasticity of the molten metal and Wrun is the weight of the runner system as supplied by the data. However, since the mold cannot be infinitely stiff, RunRate will be substantially less than E*Denc/Wrun. To provide for this, the equation is adjusted to RunRate=E*Denc/(Wrun*(1+Rac)), where Rac is the ratio of mold expansion to molten metal compression, taken from the input data. It is believed that this ratio will lie between about 1.0 and 2.0 for a typical mold.

The change in Pcav at each time step is dPcav, defined by the equation:

$$dP\text{cav}=Q-\Sigma(QOV(i))*\text{CavRate}*dT, \text{ where i is varied from 1 to } n.$$

The value of n is the total number of overflow cavities used, and CavRate is given by the equation:

$$\text{CavRate}=E*D\text{enc}/(W\text{cav}*(1+R\text{ac})).$$

Wcav is the weight of the metal in a cavity as provided by the input data.

The method of the present invention utilizes the data that is input and the parameters calculated therefrom to determine the optimum cross-sectional area for each overflow gate and the optimum volume for each overflow chamber. Once the initial data has been gathered and input, the maximum desired pressure in the main cavity is input, step 62. This will be referred to below as Pmax. The value of Pmax may directly correspond to the clamping force required to keep the mold parts, referred to herein as two halves, pressed together during the die casting process. Thus, as Pmax increases, the clamping force required to keep the mold shut must also increase. Of course, Pmax may be specified with a safety factor in mind, so that Pmax is actually much lower than the maximum clamping force of a particular die casting machine.

Next, an arbitrary value for the total cross-sectional area of the all the overflow gates combined is selected, step 64. A step-by-step integration using the physical equations described above determines how high the pressure will rise with this first estimate of total overflow gate area, termed a "peak pressure," step 66. The integration has a time step of 0.0005 milliseconds. If the peak pressure yielded by the overflow gate area is not approximately at Pmax, such as within 10 psi of Pmax, another overflow gate area is selected and the peak pressure resulting from that gate area is calculated and compared to Pmax. This process continues until a total overflow gate area that causes the peak pressure to approximately equal the maximum pressure is selected, step 68.

A first transition point is calculated, step 70, which occurs when the first overflow chamber fills with molten metal. The first transition point may be calculated from a specified runner pressure that is termed the first transition pressure. The first transition pressure that determines the first transition point may be half way between Pmax and an equilibrium pressure. The equilibrium pressure, Peq, refers to the metal pressure, given by the equation:

$$P\text{eq}=P\text{acc}*A\text{pist}/A\text{tip}.$$

The first transition pressure may thus be determined by the equation:

$$P\text{eq}+2*(P\text{max}-P\text{eq}).$$

It is important to note that this is only one way of determining the first transition point. Other ways may include the selection of a certain time period to mark where the transition occurs.

In any event, when the first transition point is found, the total overflow gate area, the plunger velocity, the total quantity of metal moved into the overflow chambers, and the runner and cavity pressures are saved, step 72. The parameters from the first transition point are used as an initial condition to perform an iteration to find a new total overflow gate area that causes the runner pressure to peak approximately at Pmax a second time, steps 74, 76 and 78. When this new peak at Pmax is found, the volume and gate area of the first overflow chamber can then be determined, step 80.

The total gate area found by the first iteration is termed Gt(1) and the total gate area found by the second iteration is termed Gt(2). The gate area of the first overflow chamber is equal to a value termed G(1), where G(1)=Gt(1)−Gt(2). The volume of the first overflow chamber must be equal to the total quantity of metal moved into the overflow chambers during the first iteration, multiplied by the ratio G(1)/Gt(1).

The iteration process is repeated to find a value of Gt for each overflow chamber, using the values found at the transition point of the previous iteration. The following algorithm expresses the iteration mathematically.

Gt(i) is the total area of the overflow gates to overflow chambers that have not yet been filled. During the ith iteration, i−1 chambers have filled. Fill(i) is the total volume of metal that has flowed out of the main cavity into the unfilled overflow chambers from the time the iteration began, i.e., at the transition point of iteration i−1, to the time of the ith transition point. Vol(i) is the volume of the ith chamber, G(i) is the cross-sectional area of the gate of the ith overflow and n is the total number of chambers calculated.

$$\text{When } i \text{ is less than } n,\ G(i)=Gt(i)-Gt(i+1)$$

$$\text{When } i \text{ equals } n,\ G(i)=Gt(i)$$

$$\text{Vol}(i)=\Sigma(\text{Fill}(j)*G(i)/Gt(j), \text{ where } j \text{ varies from 1 to } i.$$

The effect of the method includes pressure relief of the plunger as the molten metal fills the main cavity of the mold, thereby providing control over the pressure required to hold the mold halves in place. However, there is a limit to the amount of overflow chambers that may practically be included for each main cavity in the mold, step 84. A limited number of overflow chambers serves to receive substantially all of the initial air-laden metal, preserves the mechanical integrity of the die (which could be compromised with too many overflows) and allows a mold to be manufactured economically. For example, there may be a limit of eight overflow chambers, depending on the particular application. Thus, it is advantageous to relieve the pressure of the plunger with eight or fewer overflow chambers.

It should be noted that the present invention allows for the calculation of large numbers of overflow cavities, even though a smaller number of cavities may actually be considered in a particular analysis. For example, the relationship between volumetric ratios allows a calculation based on a mold having eight overflow chambers to be utilized for a mold with sixteen overflow chambers that have half of the volume of the eight chambers. This application is possible because the ratio of volumes remains constant (X cubic inches for 8 cavities=0.5X cubic inches for 16 cavities). As a result, the same analysis that yielded a smaller number of chambers may be utilized for a larger number of chambers as long as the volumetric ratio of the chambers remains constant.

If the necessary pressure relief for the plunger has not been obtained with the maximum number of overflow chambers that may be permitted in the mold, step 82, an elastic bounce of the plunger may take place that may yield a pressure higher than Pmax. To remedy such a problem, if the plunger velocity at the end of the ith iteration is below a desired value, the iteration may start over at the (i−1)th transition point. This time, instead of iterating to reach Pmax, the iteration may be predicated upon the calculation of a value of Gt(n) that produces the smallest variation in metal pressure after the last overflow chamber fills, step 86.

Another aspect of the present invention is an analysis of the conditions of a die casting system when the volume of each overflow chamber and the cross-sectional area for each corresponding overflow gate are given. In such an analysis, the initial conditions and pertinent parameters of the specific die casting process are considered, as in step 60 above. The desired volume of each overflow chamber and the cross-sectional area of each corresponding gate are also input. Rather than having values for Pmax and the total cross-sectional area of all of the gates chosen (steps 62 and 64, respectively), the equations described above are used to take the initial parameters and overflow chamber sizes that have been given and generate values for the conditions of the system. The results that are produced may include the values at specific units of time for the pressure of the molten metal in the main cavity, the pressure of the molten metal in the runner, the velocity of the plunger and the distance that the plunger traveled. Of course, maximum and/or minimum values of these and other conditions may also be generated.

To illustrate the design and the effect of the process and apparatus of the present invention, reference is made to the following examples. It is to be understood that the present invention is not limited to the examples, and various changes and modifications may be made in the invention without departing from the spirit and scope thereof.

EXAMPLES

Example 1

To illustrate the effect of the design techniques of the prior art for sizing overflow chambers and overflow gates, actual die casting machine parameters were used, including the following initial conditions and parameters:

Weight of the piston, plunger, and tip=367 lbs
Plunger velocity at impact=130 in/sec
Piston diameter=7.00 in
Piston rod diameter=4.00 in
Plunger tip diameter=4.50 in
Accumulator pressure=980 psi
Cold chamber pressure at impact=709 psi
Weight of the trimmed casting=1.15 lbs
Number of main cavities in the mold=2
Weight of the runner system=3.26 lbs
Ratio of mold expansion to molten metal compression (Rac)=2.0
Casting metal=Magnesium.

The following number and sizes of overflow chambers and gates were measured in a mold of the prior art:

| | Chamber volume (cubic in) | Gate cross-sectional area (sq in) |
|---|---|---|
| Overflow #1 | 1.136 | 0.050 |
| Overflow #2 | 1.136 | 0.060 |
| Overflow #3 | 0.947 | 0.050 |
| Overflow #4 | 1.136 | 0.050 |
| Overflow #5 | 1.136 | 0.050 |
| Overflow #6 | 1.136 | 0.061 |

As is evident from the above data, the volume of each overflow chamber according to the design methods of the prior art was substantially equal to that of the other chambers. Likewise, the cross-sectional area of each gate was substantially equal to that of the other overflow gates. Because existing overflow chamber sizes were used, no selection of Pmax was necessary.

Figure 5:
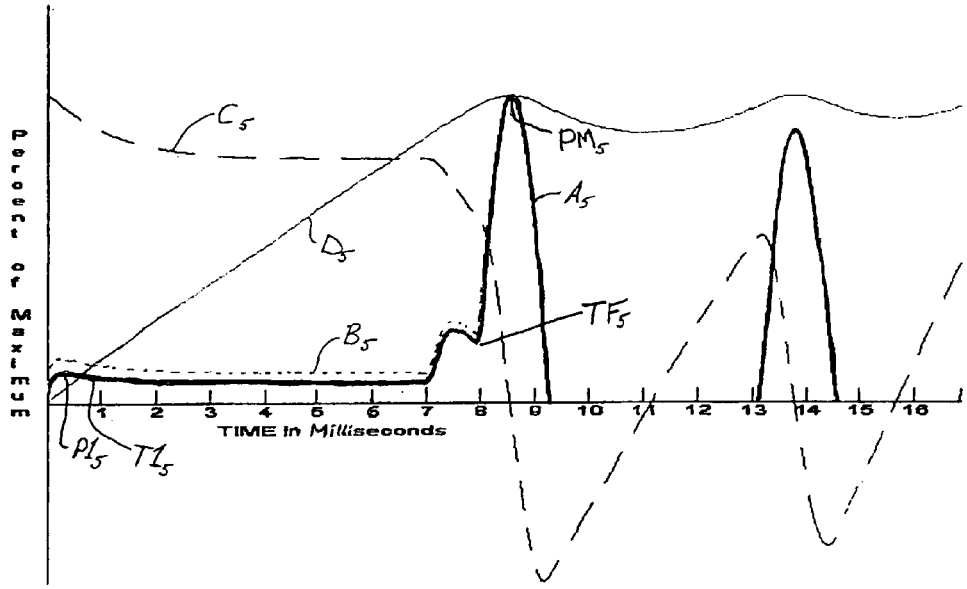
FIG. 5 PRIOR ART
FIG. 5 is a diagram illustrating the results of prior art sizing techniques on a die casting system.

The results of such prior art sizing are illustrated in the curves of FIG. 5, where the thick solid line, $A_5$, represents the pressure of the molten metal in the main cavity of the mold, the line with short dashes, $B_5$, represents the pressure of the molten metal in the runner, the line with the long dashes, $C_5$, represents the velocity of the plunger, and the thin solid line, $D_5$, represents the distance that the plunger traveled.

The vertical scale shows the value of each measured parameter (i.e., the pressure of the molten metal in the main cavity, the pressure of the molten metal in the runner, the velocity of the plunger and the distance the plunger traveled) as a fraction of its maximum value achieved during the run. The horizontal scale indicates the time at which the values were obtained.

The first peak pressure in the main cavity, $P\mathbf{1}_5$, occurred at a time of approximately 0.25 milliseconds. The first transition point $T\mathbf{1}_5$, which is the point at which the first overflow chamber filled, occurred at a time of 0.85 milliseconds. The last overflow chamber filled at a final transition point, $TF_5$, about 7.9 milliseconds after metal started to flow into the overflow chambers. From this time until a time of about 9.2 milliseconds, the mold and molten metal acted in an elastic manner, where the relationship between pressure and plunger displacement was linear, as line $D_5$ shows. Between the time of about 9.2 milliseconds and about 13.0 milliseconds, the plunger came to a stop and then reversed direction, actually backing off from the metal in an elastic impact. This elastic impact is a "bounce" of the plunger that is often observable.

A maximum peak pressure, $PM_5$, of 13,763 psi was calculated, a value that is considered to be very high (in these examples, it is assumed that a pressure above about 6,500 psi would challenge the clamping capacity of the die casting machine). It was assumed for the calculations that the mold never opened due to the pressure that was achieved. It is to be noted that metal pressure has never truly been accurately measured, leading to an assumption that the metal was fluid throughout the time period shown in FIG. 5. While it is conceivable that some solidification may have taken place, such as the formation of a skin on the molten metal, the metal as a whole acted in a fluid manner for a time period typically up to about 20 milliseconds, allowing the assumption of fluidity to accurately predict the actual behavior of the metal.

Thus, the methods of sizing overflow chambers according to the prior art do not significantly reduce the pressure in the system.

Example 2

As a first step in illustrating the effect of the method of the present invention, the cross-sectional areas of the overflow gates of Example 1 were modified. Specifically, the parameters and overflow chamber volumes of Example 1 were retained, while the cross-sectional area of each gate of Example 1 was cut in half:

| | Chamber volume (cubic in) | Gate cross-sectional area (sq in) |
|---|---|---|
| Overflow #1 | 1.136 | 0.025 |
| Overflow #2 | 1.136 | 0.031 |

-continued

| | Chamber volume (cubic in) | Gate cross-sectional area (sq in) |
|---|---|---|
| Overflow #3 | 0.947 | 0.025 |
| Overflow #4 | 1.136 | 0.025 |
| Overflow #5 | 1.136 | 0.025 |
| Overflow #6 | 1.136 | 0.030 |

Figure 6:
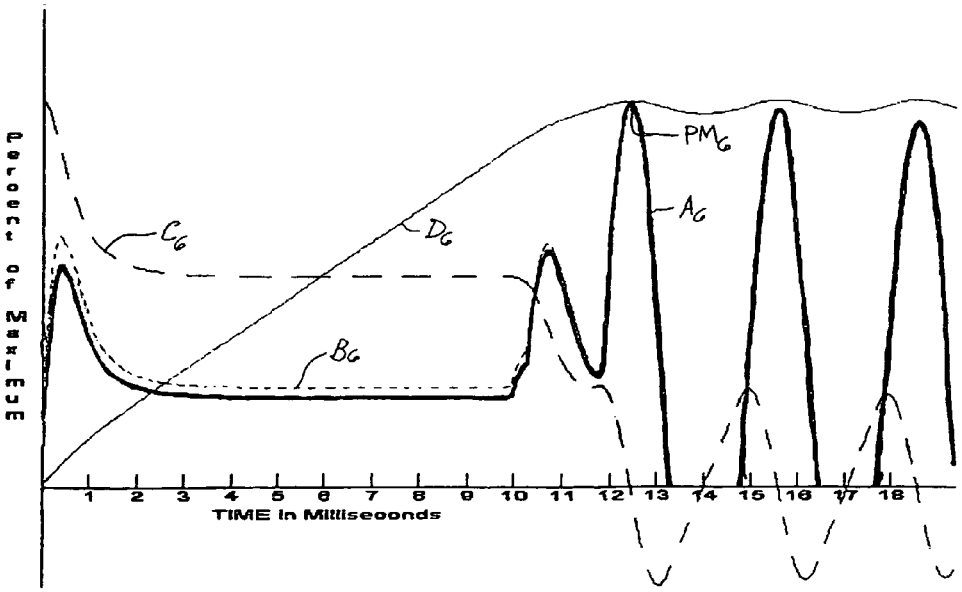
FIG. 6 is a diagram illustrating the results of an embodiment of the present invention on a die casting system.

The effect of this modification on the die casting system is presented in FIG. 6. The thick solid line, $A_6$, represents the pressure of the molten metal in the main cavity of the mold, the line with short dashes, $B_6$, represents the pressure of the molten metal in the runner, the line with the long dashes, $C_6$, represents the velocity of the plunger, and the thin solid line, $D_6$, represents the distance that the plunger traveled.

The reduction of the overflow gate areas substantially below the area of the main gate cut the maximum pressure peak $PM_6$ from over 13,000 psi in Example 1 to a calculated value of 7,330 psi. This reduction of pressure also reduced the magnitude of the bounce of the plunger, observable in line $D_6$ from 13.0 milliseconds to about 15.0 milliseconds, from that of Example 1. However, the maximum pressure peak $PM_6$ is still considered to be high and the pounding that the mold experiences due to the bounces is not eliminated by arbitrarily reducing the overflow gate sizes.

Example 3

Using the method of the present invention as described above, the initial conditions and parameters of Example 1 were used to size the volume of each overflow chamber and each overflow gate to reduce the pressure in the system below a maximum cavity pressure of 3,500 psi. To reiterate, the following initial data was used:

Weight of the piston, plunger, and tip=367 lbs
Plunger velocity at impact=130 in/sec
Piston diameter=7.00 in
Piston rod diameter=4.00 in
Plunger tip diameter=4.50 in
Accumulator pressure=980 psi
Cold chamber pressure at impact=709 psi
Weight of the trimmed casting=1.15 lbs
Number of main cavities in the mold=2
Weight of the runner system=3.26 lbs
Ratio of mold expansion to molten metal compression (Rac)=2.0
Casting metal=Magnesium.

As mentioned, a value of Pmax (the maximum desired cavity pressure) was chosen to be 3,500 psi. The following number and sizes of overflow chambers and gates were determined using the method of the present invention:

| | Chamber volume (cubic in) | Gate cross-sectional area (sq in) |
|---|---|---|
| Overflow #1 | 0.220 | 0.055 |
| Overflow #2 | 0.348 | 0.042 |
| Overflow #3 | 0.441 | 0.034 |
| Overflow #4 | 0.519 | 0.029 |
| Overflow #5 | 0.598 | 0.026 |
| Overflow #6 | 0.477 | 0.017 |
| Overflow #7 | 0.393 | 0.012 |

As the data illustrates, the volume of each overflow chamber as sized by the method of the present invention is not equal to the other chambers and the cross-sectional area of each overflow gate is not equal to the area of the other gates.

Figure 7:
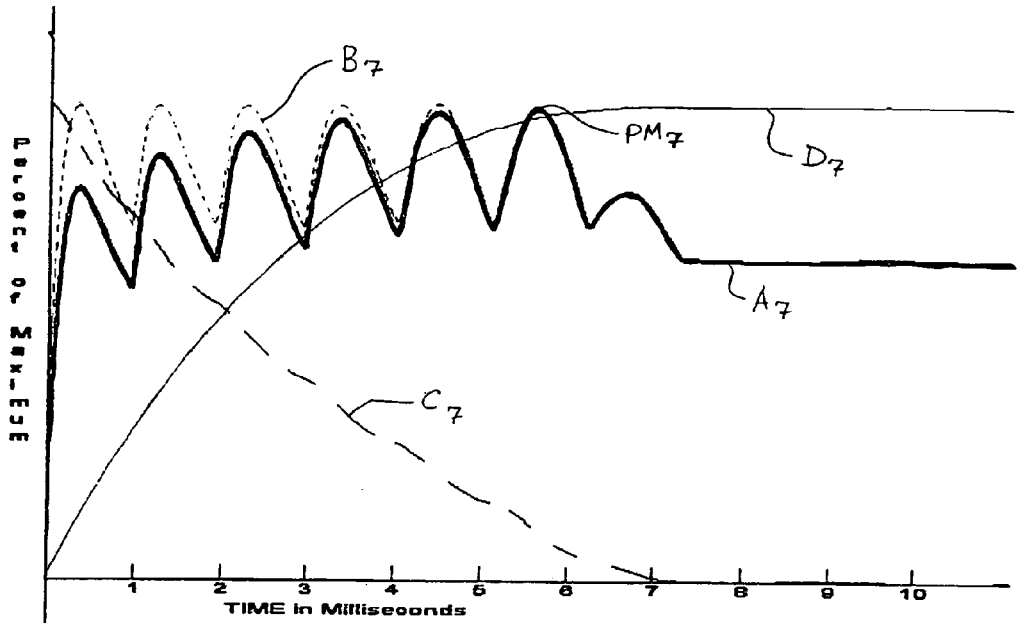
FIG. 7 is a diagram illustrating the results of another embodiment of the present invention on a die casting system.

Turning to FIG. 7, the thick solid line, $A_7$, represents the pressure of the molten metal in the main cavity of the mold, the line with short dashes, $B_7$, represents the pressure of the molten metal in the runner, the line with the long dashes, $C_7$, represents the velocity of the plunger, and the thin solid line, $D_7$, represents the distance that the plunger traveled. The maximum peak impact pressure in the main cavity, $PM_7$, has been reduced to 3,498 psi, below the desired limit of 3,500 psi. In addition, as the smooth curve of line $D_7$ indicates, there was no bounce or subsequent pounding of the mold.

It should be noted that the total volume of the overflow chambers that was determined was just over one third of what was deemed necessary by methods of the prior art. Because the total cross-sectional area of the overflow gates conventionally is set equal to the cross-sectional area of the main gate, it can be seen that the total cross-sectional area of the overflow gates according to the invention is substantially less than the cross-sectional area of the main gate, such as less than one-half of the area of the main gate. However, it is possible that some of the overflow chambers in this example, such as number 1, would be too small to practically manufacture and would not provide adequate overflow volume.

Example 4

To be practical, the die casting process must maintain low impact while providing enough overflow volume to remove the aerated metal. In order to accomplish this, the preferred method of the present invention provides a delay feature.

The delay feature allows a time delay before which deceleration begins to be specified. This is accomplished by reducing the peak pressure of the first iteration and specifying that the first transition take place at the delay time instead of by reaching a certain pressure. For example, the peak pressure of the first iteration may be set equal to the equilibrium pressure (Peq).

It is believed that by approximating the total overflow volume of the prior art, the chambers will provide adequate overflow volume to remove aerated metal from the main cavity. Thus, through trial and error, it was determined that a delay time of 4.9 milliseconds yielded a total overflow volume of the chambers that was roughly equal to the total overflow volume of the prior art from Example 1.

Using the method of the present invention and the same initial parameters listed above, the following number and sizes of overflow chambers and gates were determined:

| | Chamber volume (cubic in) | Gate cross-sectional area (sq in) |
|---|---|---|
| Overflow #1 | 1.946 | 0.135 |
| Overflow #2 | 0.778 | 0.041 |
| Overflow #3 | 0.788 | 0.033 |
| Overflow #4 | 0.819 | 0.028 |
| Overflow #5 | 0.872 | 0.025 |
| Overflow #6 | 0.597 | 0.015 |
| Overflow #7 | 0.414 | 0.009 |

Figure 8:
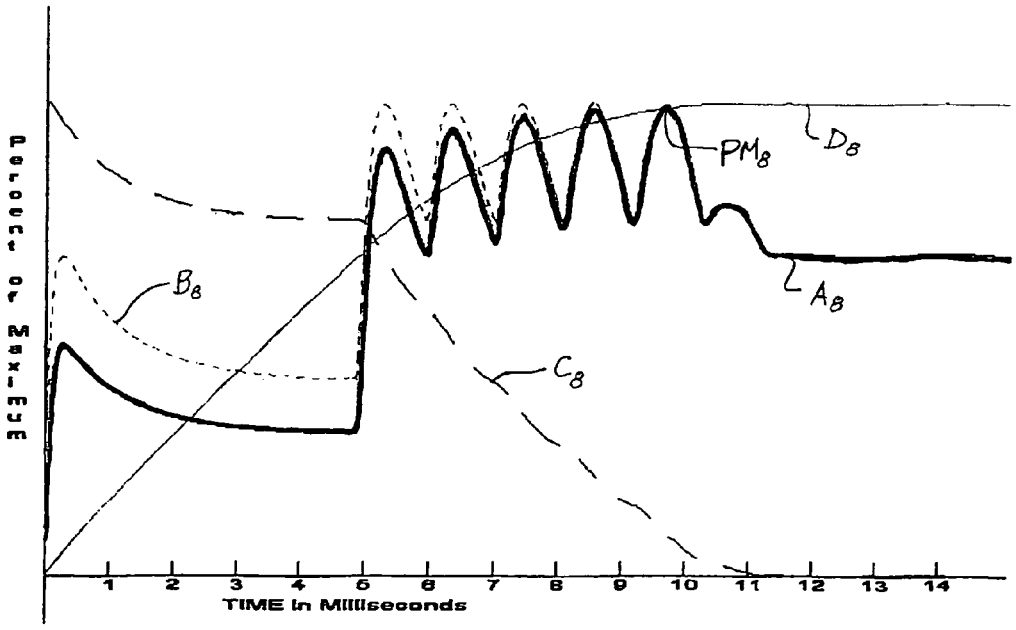
FIG. 8 is a diagram illustrating the results of yet another embodiment of the present invention on a die casting system.

With reference to FIG. 8, the result of a run using the delay feature is illustrated. The thick solid line, $A_8$, represents the pressure of the molten metal in the main cavity of the mold, the line with short dashes, $B_8$, represents the pressure of the molten metal in the runner, the line with the long dashes, $C_8$, represents the velocity of the plunger, and the thin solid line, $D_8$, represents the distance that the plunger traveled. The maximum peak impact pressure in the main cavity, $PM_8$, was 3,499 psi, below the chosen limit of 3,500 psi. Also, as the smooth curve of line $D_8$ indicates, there was no bounce.

When a delay is incorporated, the behavior of the system becomes substantially insensitive to the volume of the first two overflow chambers that are calculated. This means that if the first or the first and second overflow chambers that are calculated are placed where the flowing metal first encounters an extremity of the main cavity, these chambers can fill partially before the others start to fill without significantly affecting the low pressure design.

Example 5

The die casting process must also allow for the fact that some overflows may start to fill before the metal front reaches others. When the molten metal reaches an extremity of the die cavity, the metal can flow into an overflow or it can move along the wall of the main cavity toward any void that remains unfilled. In the instance of movement along the wall, the resistance to flow along the wall is much less than the resistance to flow through a gate to an overflow chamber. This is particularly true of the more restrictive gates calculated by the method of the present invention.

For example, a void volume equal to the total volume of the overflow chambers of a mold may fill completely before ten percent of that volume is driven into the overflow chambers. With a reasonably good arrangement of the gate(s) for the main cavity, it is unlikely that a void as big as the total volume of the overflow chambers would exist when the front reaches the first overflow gate. However, if ten percent of the total overflow volume had flowed into a volume of 1.946 cubic inches (the volume of the first chamber in the previous Example), there would only be 1.325 cubic inches left in that chamber when the other chambers started to fill.

The behavior of the system was examined using the same mold parameters as Example 4 above, but in the situation where the first chamber had only 1.325 cubic inches left when the other overflows started to fill. Thus, the number and sizes of overflow chambers and gates changed from those listed in Example 4 to:

| | Chamber volume (cubic in) | Gate cross-sectional area (sq in) |
|---|---|---|
| Overflow #1 | 1.325 | 0.135 |
| Overflow #2 | 0.778 | 0.041 |
| Overflow #3 | 0.788 | 0.033 |
| Overflow #4 | 0.819 | 0.028 |
| Overflow #5 | 0.872 | 0.025 |
| Overflow #6 | 0.597 | 0.015 |
| Overflow #7 | 0.414 | 0.009 |

Figure 9:
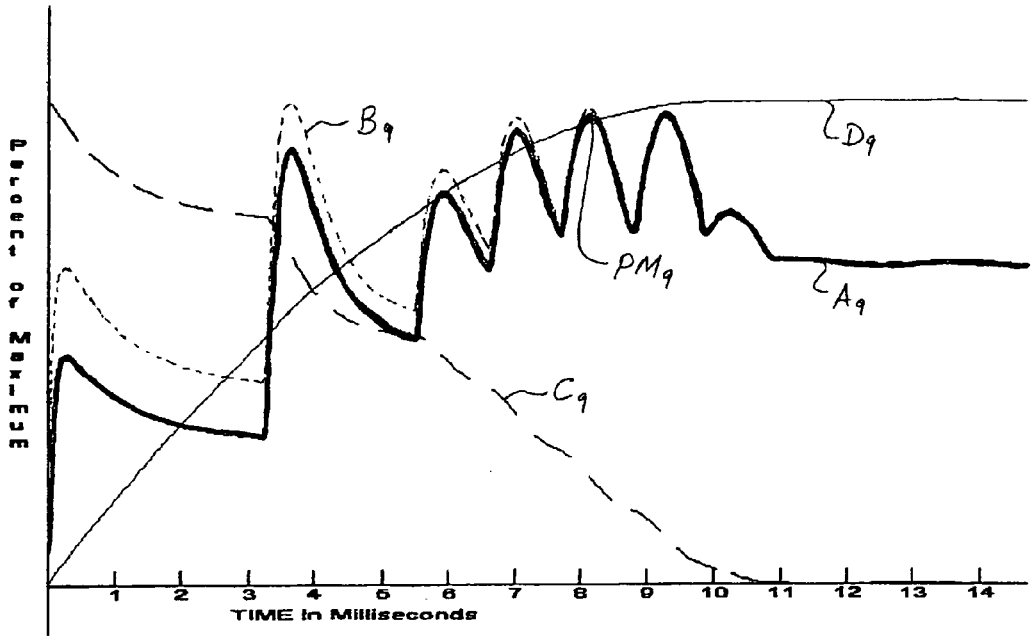
FIG. 9 is a diagram illustrating the results of still another embodiment of the present invention on a die casting system.

In addition, because these given overflow sizes were used, no selection of Pmax was necessary. With reference to FIG. 9, the thick solid line, $A_9$, represents the pressure of the molten metal in the main cavity of the mold, the line with short dashes, $B_9$, represents the pressure of the molten metal in the runner, the line with the long dashes, $C_9$, represents the velocity of the plunger, and the thin solid line, $D_9$, represents the distance that the plunger traveled. The resulting maximum peak impact pressure in the main cavity, $PM_9$, was calculated to be 3,569 psi, only 69 psi higher than that of Example 4. Moreover, the lack of bounce (line $D_9$) is just as good as in Example 4.

The behavior of the system was also examined in the situation where the first chamber had only 1.325 cubic inches of open volume remaining and 0.2 cubic inches of metal entered the second overflow chamber (leaving 0.578 cubic inches remaining) before the other volumes started to fill. With these considerations, the number and sizes of overflow chambers and gates changed to:

| | Chamber volume (cubic in) | Gate cross-sectional area (sq in) |
|---|---|---|
| Overflow #1 | 1.325 | 0.135 |
| Overflow #2 | 0.578 | 0.041 |
| Overflow #3 | 0.788 | 0.033 |
| Overflow #4 | 0.819 | 0.028 |
| Overflow #5 | 0.872 | 0.025 |
| Overflow #6 | 0.597 | 0.015 |
| Overflow #7 | 0.414 | 0.009 |

Figure 10:
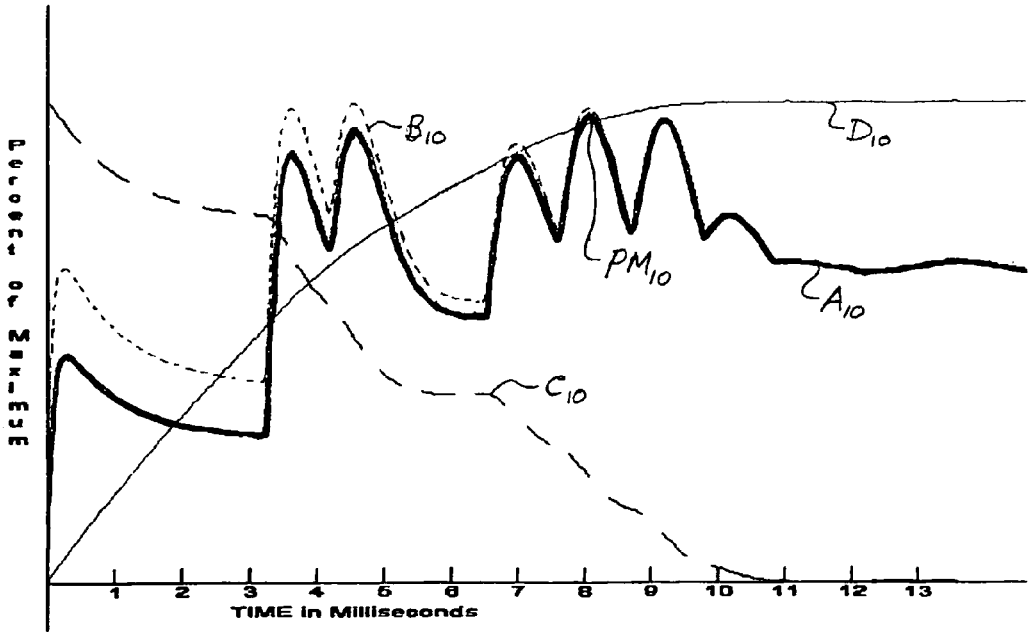
FIG. 10 is a diagram illustrating the results of yet another embodiment of the present invention on a die casting system.

With reference to FIG. 10, the thick solid line, $A_{10}$, represents the pressure of the molten metal in the main cavity of the mold, the line with short dashes, $B_{10}$, represents the pressure of the molten metal in the runner, the line with the long dashes, $C_{10}$, represents the velocity of the plunger, and the thin solid line, $D_{10}$, represents the distance that the plunger traveled. The maximum peak impact pressure, $PM_{10}$, was calculated to be 3,602 psi with a similar lack of bounce (line $D_{10}$) to that of FIG. 9.

Example 6

As mentioned above, the effect of mold deflection should lie between one and two times the effect of metal compression. For the purpose of confirming this relationship, the die casting system was analyzed using the initial conditions and parameters of the above examples, except that the ratio of mold expansion to molten metal compression (Rac) was set equal to 1.0, rather than 2.0. The overflow chambers and gates were of similar sizes to those analyzed above in Example 4:

| | Chamber volume (cubic in) | Gate cross-sectional area (sq in) |
|---|---|---|
| Overflow #1 | 1.946 | 0.135 |
| Overflow #2 | 0.778 | 0.041 |
| Overflow #3 | 0.788 | 0.033 |
| Overflow #4 | 0.819 | 0.028 |
| Overflow #5 | 0.872 | 0.025 |
| Overflow #6 | 0.597 | 0.015 |
| Overflow #7 | 0.414 | 0.009 |

Figure 11:
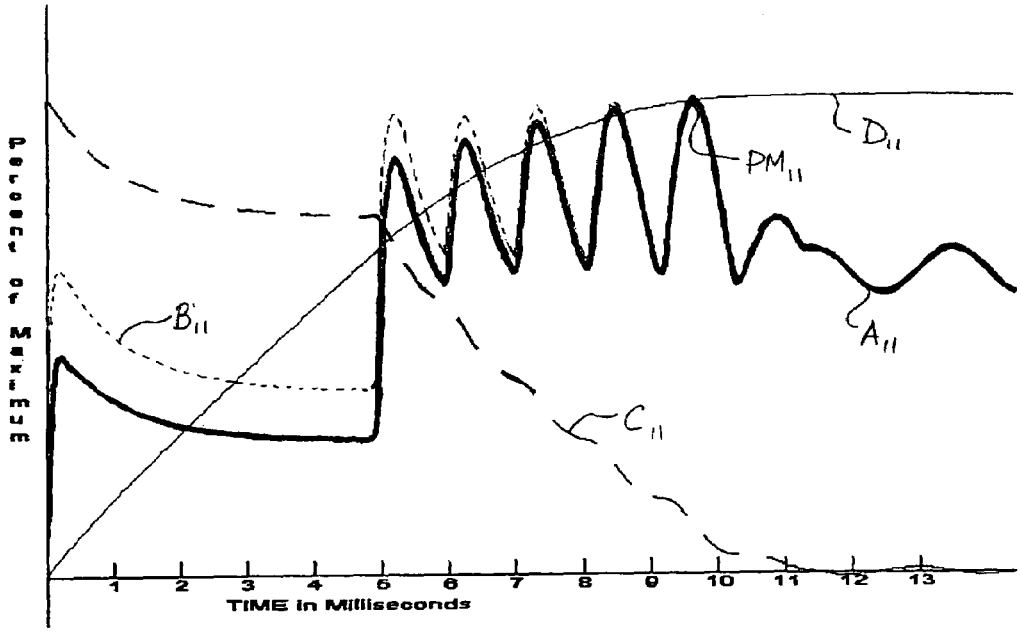
FIG. 11 is a diagram illustrating the results of still another embodiment of the present invention on a die casting system.

With reference to FIG. 11, the thick solid line, $A_{11}$, represents the pressure of the molten metal in the main cavity of the mold, the line with short dashes, $B_{11}$, represents the pressure of the molten metal in the runner, the line with the long dashes, $C_{11}$, represents the velocity of the plunger, and the thin solid line, $D_{11}$, represents the distance that the plunger traveled. The maximum peak impact pressure, $PM_{11}$, was calculated to be 3,748 psi and there was negligible bounce, as the smooth curve of line $D_{11}$ illustrates.

Figure 12:
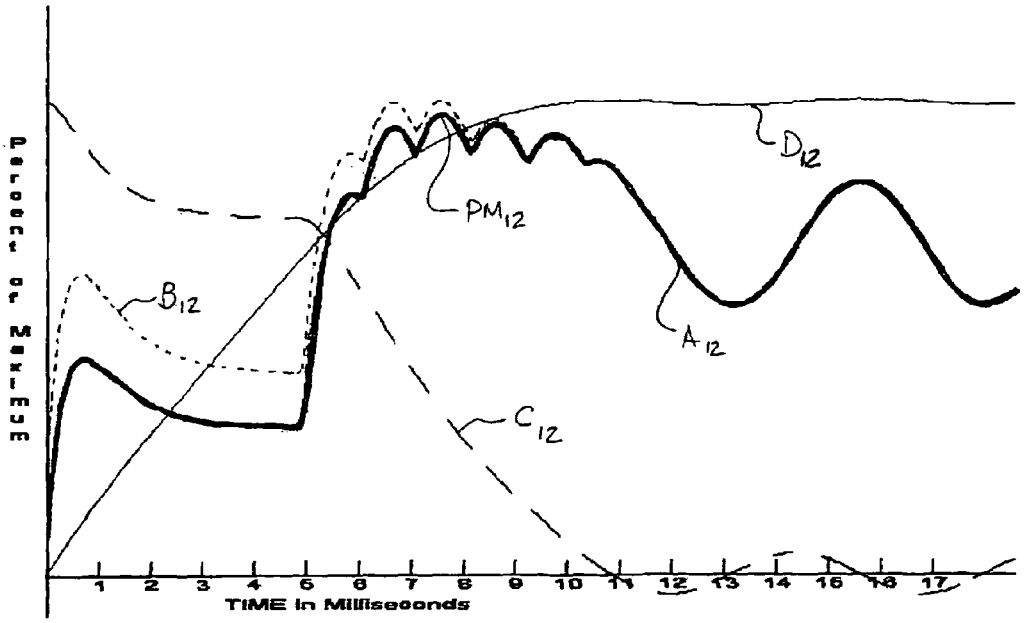
FIG. 12 is a diagram illustrating the results of yet another embodiment of the present invention on a die casting system.

The die casting system was analyzed again using the above initial conditions and parameters, except that the ratio of mold expansion to molten metal compression (Rac) was set equal to 10.0. The overflow chambers and gates were of the same sizes as those listed above for this Example. Turning to FIG. 12, the thick solid line, $A_{12}$, represents the pressure of the molten metal in the main cavity of the mold, the line with short dashes, $B_{12}$, represents the pressure of the molten metal in the runner, the line with the long dashes, $C_{12}$, represents the velocity of the plunger, and the thin solid line, $D_{12}$, represents the distance that the plunger traveled. The maximum peak impact pressure, $PM_{12}$, was calculated to be 3,400 psi and there was some minor bounce, as line $D_{11}$ illustrates.

Taken together, FIGS. 11 and 12 show that overflow sizes determined using one value of Rac work well over the whole range of values of Rac and beyond, as a value of 10.0 for Rac is considered to be out of the range of possible values for Rac. Typically, applications involving thick-walled castings have a lower value of Rac, usually in a range of about 0.5 to about 1.0. Applications involving thin-walled castings normally have a higher value for Rac, usually in a range of about 2.0 to about 3.0.

As is apparent from the foregoing detailed description, the invention includes molds that define overflow gates designed according to the method of the present invention, including overflow gates having cross-sectional areas that are smaller than the cross-sectional area of the main gate of the mold. The invention also includes molds that define overflow chambers designed according to the method of the present invention as described in FIGS. 1–12 above.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A mold for the die casting of metals, comprising a mold body that defines:

at least one main cavity;

a main gate for the at least one main cavity;

at least two overflow chambers; and an overflow gate for each overflow chamber, wherein the total cross-sectional area of the overflow gates is substantially less than the cross-sectional area of the main gate.

2. The mold for the die casting of metals of claim 1, wherein the total cross-sectional area of the overflow gates is less than one-half of the cross-sectional area of the main gate.

* * * * *